United States Patent [19]

Paakkinen

[11] Patent Number: 4,574,064

[45] Date of Patent: Mar. 4, 1986

[54] METHOD FOR CONTINUOUS CASTING OF OBJECTS OUT OF A HIGH-VISCOSITY CASTING MIX

[75] Inventor: Ilmari Paakkinen, Toijala, Finland

[73] Assignee: Oy Partek AB, Toijala, Finland

[21] Appl. No.: 506,548

[22] PCT Filed: Oct. 21, 1982

[86] PCT No.: PCT/FI82/00046

§ 371 Date: Jun. 10, 1983

§ 102(e) Date: Jun. 10, 1983

[87] PCT Pub. No.: WO83/01593

PCT Pub. Date: May 11, 1983

[30] Foreign Application Priority Data

Nov. 10, 1981 [FI] Finland ..... 813556

[51] Int. Cl.[4] ..... B28B 1/08

[52] U.S. Cl. ..... 264/70; 264/33; 264/71; 425/429; 425/432; 425/456

[58] Field of Search ..... 264/33, 70, 71, 72; 425/429, 432, 456

[56] References Cited

U.S. PATENT DOCUMENTS

| | | | |
|---|---|---|---|
| 2,670,515 | 3/1954 | Wigley | 425/456 |
| 3,497,579 | 2/1970 | Barron | 264/33 |
| 4,253,810 | 3/1981 | Bezhavov et al. | 425/432 |

FOREIGN PATENT DOCUMENTS

| | | | |
|---|---|---|---|
| 0679494 | 2/1964 | Canada | 264/33 |
| 0959626 | 3/1957 | Fed. Rep. of Germany . | |
| 1078173 | 11/1954 | France . | |

*Primary Examiner*—Jan Silbaugh
*Assistant Examiner*—Hubert C. Lorin
*Attorney, Agent, or Firm*—Burns, Doane, Swecker & Mathis

[57] ABSTRACT

The invention is concerned with a method for continuous slide-casting of large-size concrete objects or corresponding elements for compacting high-viscosity casting mix. The slide-casting mould (33) comprises a bottom plane (34), side walls (38, 39) of the mould, as well as means (37) for pressurizing the casting mix mechanically. According to the invention, before the parallel side walls (44, 54) at the outlet end of the slide-casting mould (33), within the casting line concerned, walls or wall portions (40 to 43, 50 to 53) are provided as fitted to each other or to their corresponding portions, provided as pairs, as pivotable always in the same direction around substantially vertical shafts (45 to 49, 55 to 59) included in their planes. The moving parts of the side walls (38, 39) may be displaced in pairs in the lateral direction, relative the casting direction, e.g., by means of cylinder-piston devices (61 to 63). Thereat, repeated parallel dislocations back and forth are produced in the various regional zones of the mechanically pressurized high-viscosity casting mix (35) present in the slide-casting mould (33), and in particular in parallel dislocation planes of casting mix (35) in the mould (33), placed perpendicularly to the longitudinal direction of the casting base.

4 Claims, 10 Drawing Figures

METHOD FOR CONTINUOUS CASTING OF OBJECTS OUT OF A HIGH-VISCOSITY CASTING MIX

Figure 1:
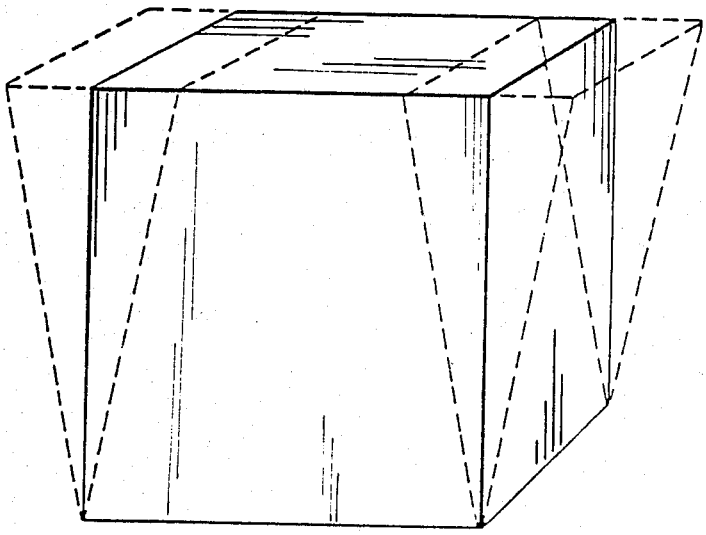

The present invention is concerned with a method in continuous slide-casting of large-size concrete objects or corresponding elements for compacting the high-viscosity casting mix. The invention also comprises a slide-casting mould for carrying out the method, whereat the mould comprises a bottom plane, side walls of the mould, as well as means for bringing the high-viscosity casting mix mechanically under pressure.

In prior art, it is known to compact the concrete mix by vibration, or to bring the concrete mix in the mould mechanically under pressure by pressing one wall of the mould against the concrete mix. Thereat, in connection with the pressing action, the wall may additionally be varied between various angular positions. In prior art, it is also known to cast hollow slabs out of high-viscosity concrete mix by means of the slide-cast method. In such a case, the cavities of the hollow slab are formed by means of the slide-casting machine so that no thick wall strengths remain in the slab. It is the presence of the cavities that permits the compacting of the high-viscosity concrete mix in the said slide-cast method. On the contrary, in prior art it has not been possible to cast such massive concrete objects or elements whose smallest dimension is also at least tens, possibly even hundreds of millimeters, out of a high-viscosity concrete mix (water/cement ratio about 0.28 to 0.33).

It is an object of the present invention to permit slide-casting of large-size concrete objects or corresponding elements out of a high-viscosity concrete mix, and the method in accordance with the invention is mainly characterized in that repeated parallel dislocations back and forth are produced in the various regional zones of the mechanically pressurized high-viscosity casting mix present in the mould, and in particular in parallel dislocation planes of casting mix placed perpendicularly to the longitudinal direction of the casting base, by pivoting at least two opposite walls or wall portions of the slide-casting mould as synchronized and always in the same direction in relation to each other, which pivoting takes place around substantially vertical shafts placed at a distance from each other, included in the planes of the said mould walls, and being placed side by side in relation to the longitudinal direction of the casting base.

The slide-casting mould in accordance with the invention is mainly characterized in that before the parallel side walls at the outlet end of the slide-casting mould, within the casting line concerned, walls or wall portions are provided as fitted to each other or to their corresponding portions, provided as pairs, as pivotable always in the same direction around substantially vertical shafts included in their planes, whereat, by pivoting the said walls or wall portions, e.g. by means of cylinder-piston devices, repeated parallel dislocations back and forth can be produced in parallel displacement planes placed transversally to the longitudinal direction of the casting base in the casting mix present in the mould.

Figure 2:
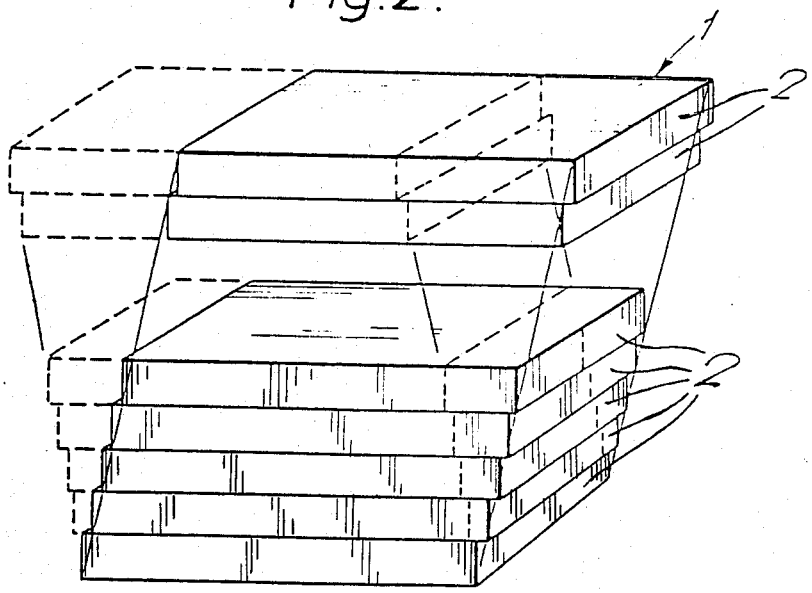
Figure 3:
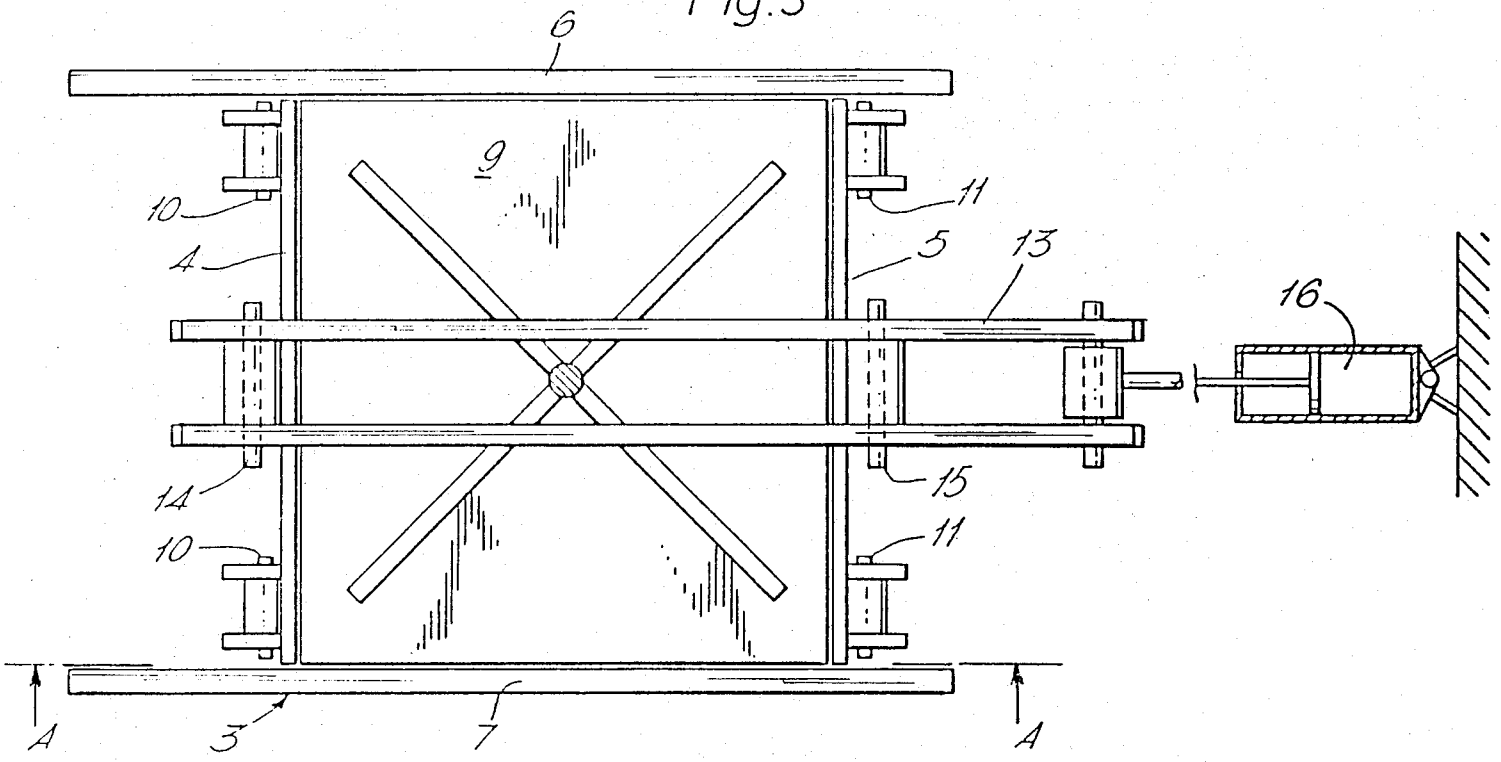
Figure 4:
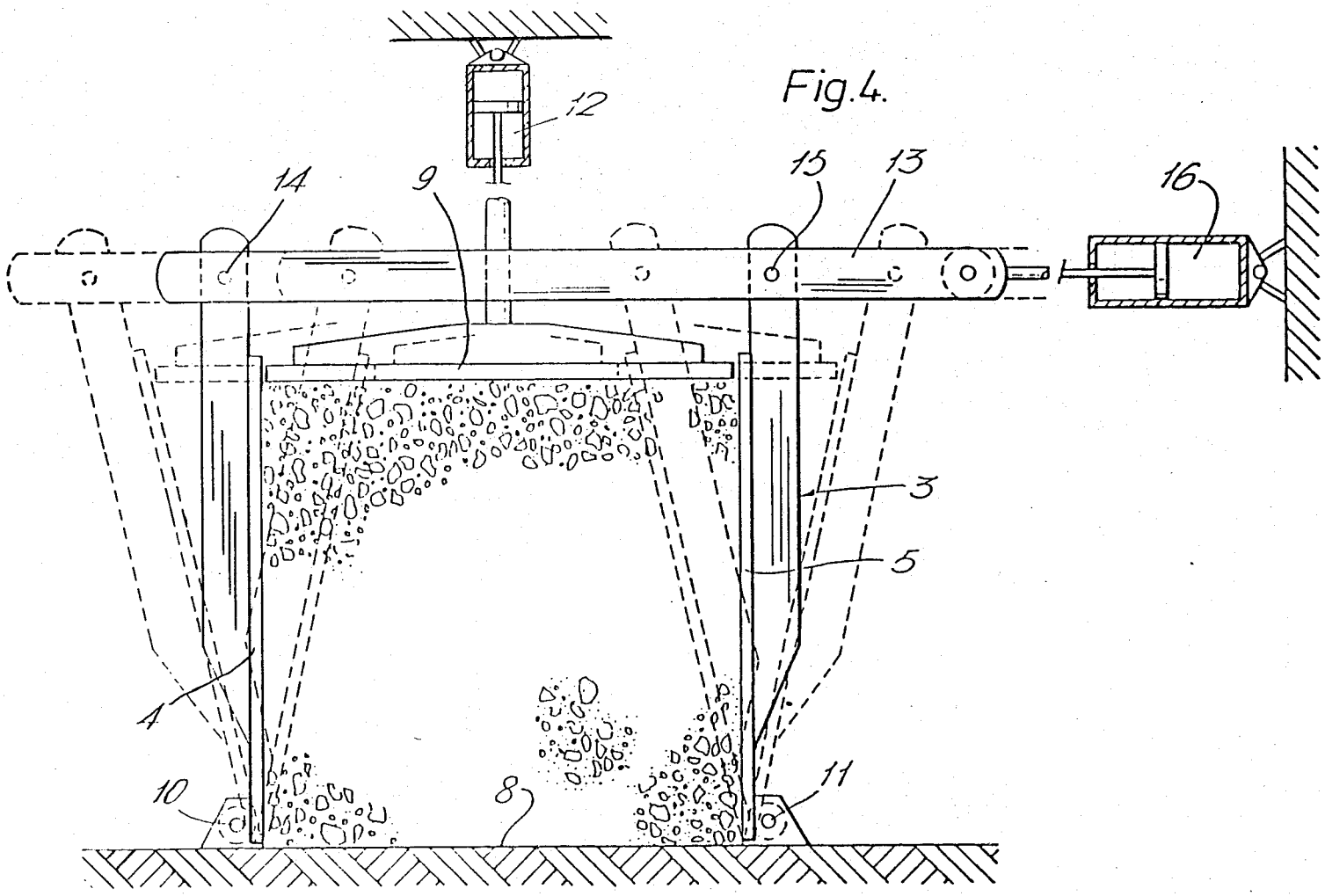
Figure 5:
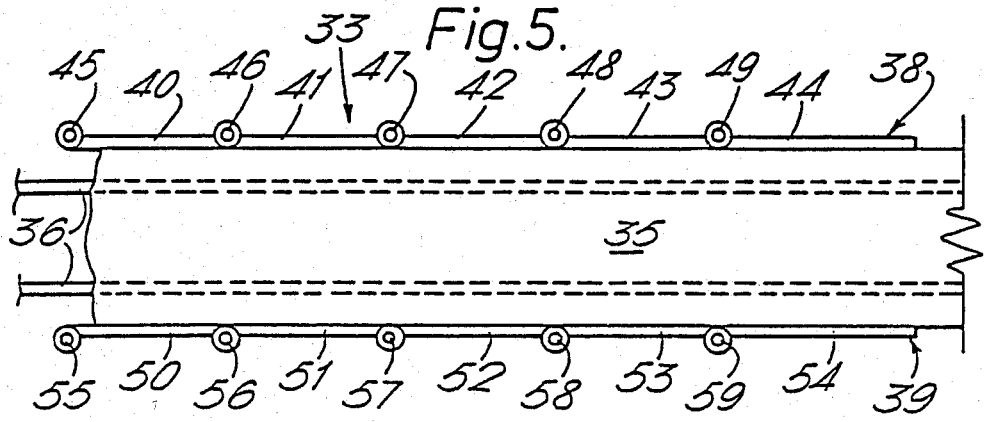
Figure 6:
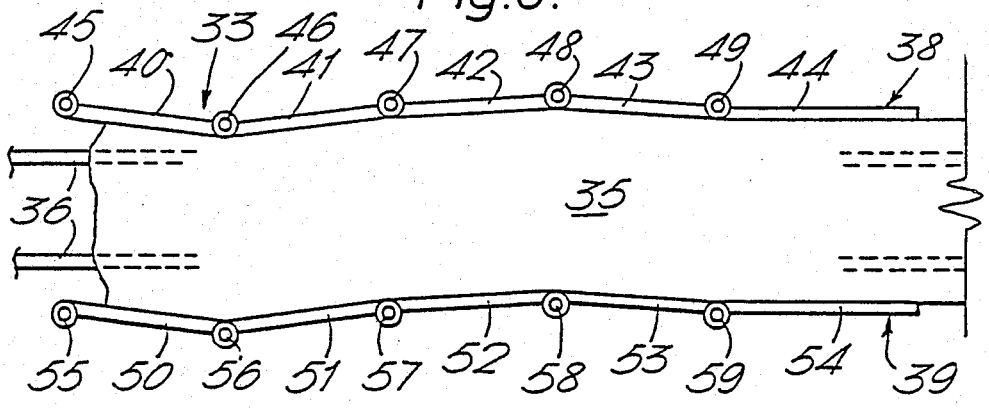
Figure 7:
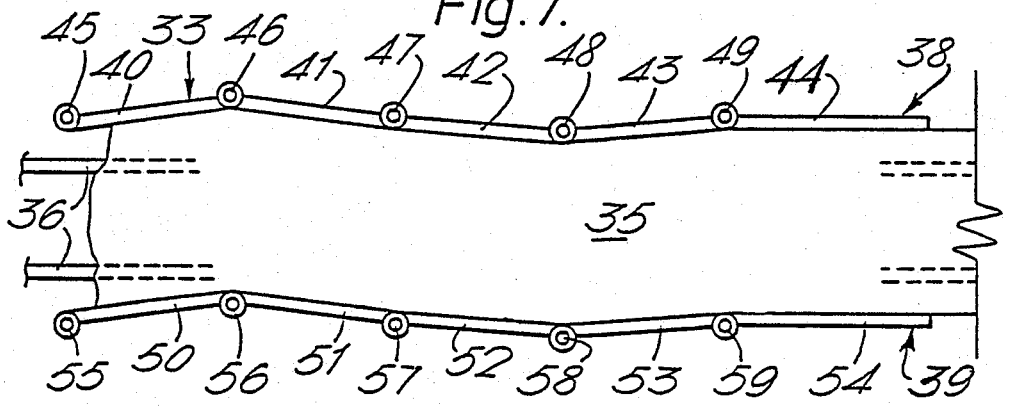
Figure 8:
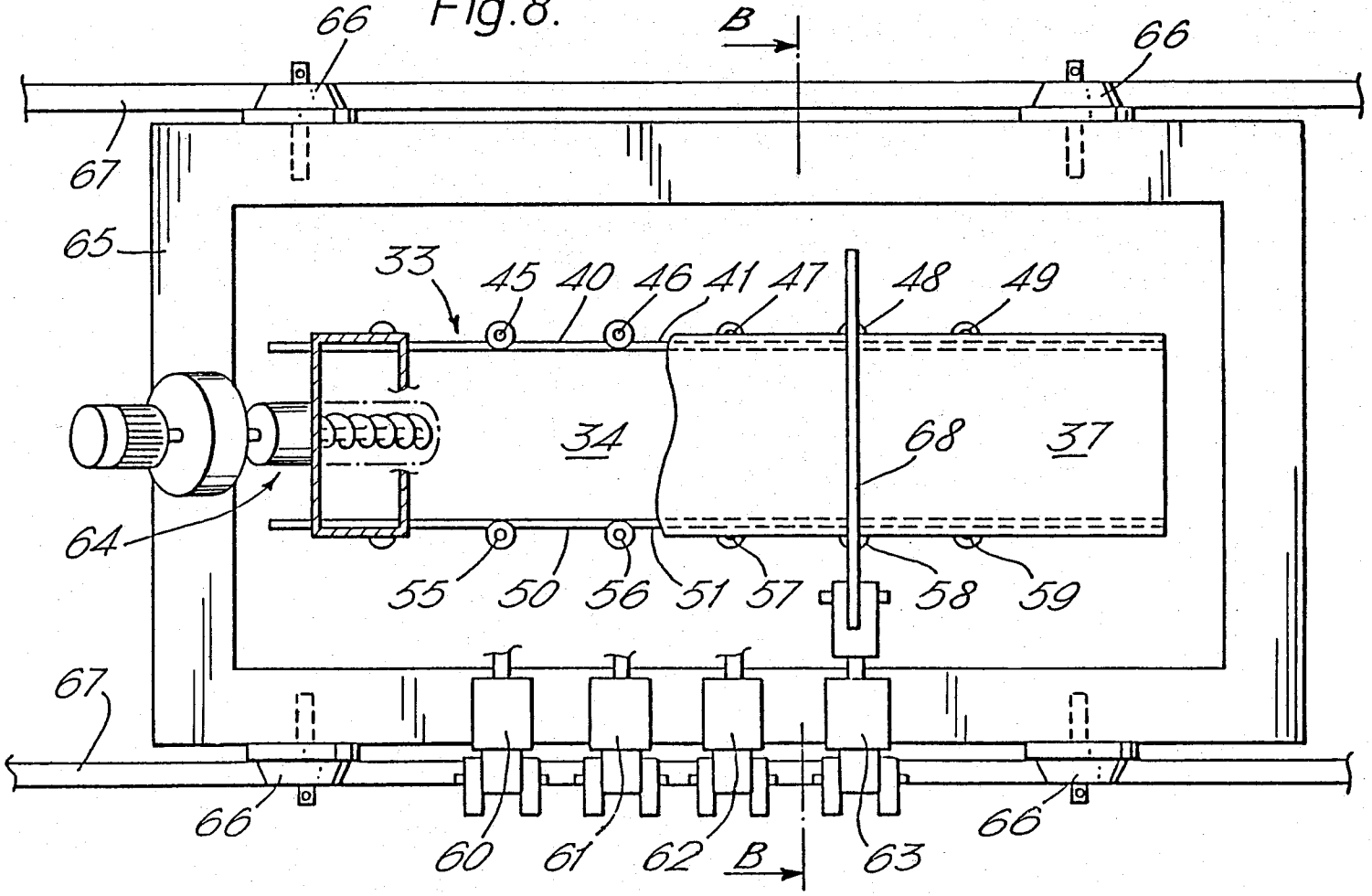
Figure 9:
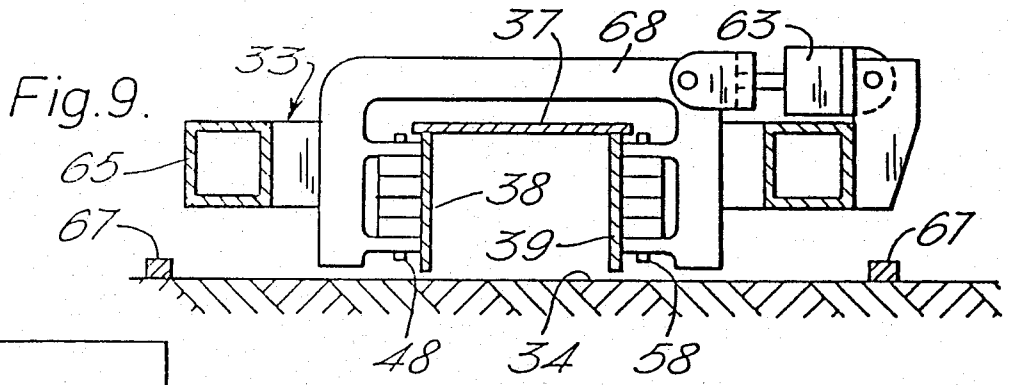
Figure 10:
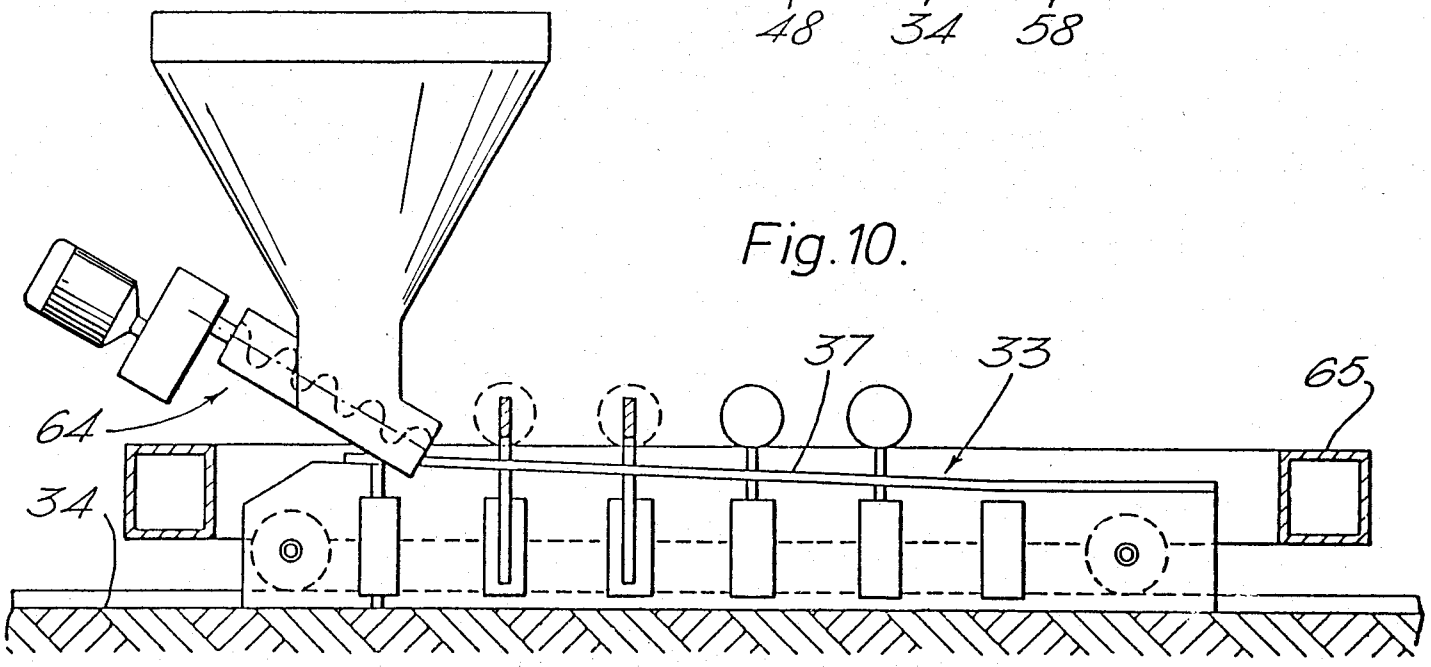

The invention comes out more specifically from the following description and from the attached drawings, wherein FIG. 1 is a schematical presentation of the principle of the process of compacting of the concrete mix, FIG. 2 illustrates the gliding of the thin lamellae or dislocation planes, placed one above the other, of the concrete object to be compared, in relation to each other in a cubic cast piece, FIG. 3 is a schematical presentation of a casting mould as viewed from above, FIG. 4 shows a section at A—A in FIG. 3, FIGS. 5 to 7 show a slide-casting mould in accordance with the invention in its various operating positions as viewed from above, FIG. 8 is a more detailed view of the slide-casting mould as viewed from above, FIG. 9 shows a section at B—B in FIG. 8, and FIG. 10 shows the mould of FIGS. 8 and 9 as a side view.

To begin with, the process of working of a high-viscosity concrete mix will be explained with reference to FIGS. 1 to 4.

In FIG. 1, it is assumed that the object to be compacted out of high-viscosity concrete mix has the shape of a cube, shown in full lines. In order that the high-viscosity concrete mix should be really compacted in all parts of the concrete object, in the concrete mix an efficient dislocation of all of the areas in the mix in relation to each other must be produced throughout the entire object. In the case of FIGS. 1 to 4, this is achieved so that the concrete mix is first brought mechanically under pressure and that thereafter, in parallel dislocation planes in the concrete mix, repeated parallel dislocations back and forth are produced by synchronously pivoting two opposite mould walls in relation to each other. In FIG. 1, the paths of movement of the two wall planes concerned are denoted with broken lines.

In order to illustrate the matter, in FIG. 2, the object 1 to be compacted is conceived as consisting of thin lamellae or dislocation planes 2 placed one above the other. When the object 1 is, during compacting, shaped diagonally, the lamellae or dislocation planes 2 glide in relation to each other. In FIG. 2, one extreme position of the working is presented with full lines and the other exterme position with broken lines. In the process of working in accordance with FIGS. 1 to 4, the frequency of oscillation may be up to 10 to 20 oscillations back and forth per second, preferably, however, about 1 to 5 oscillations back and forth per second. Thereat, during the working, the lamellae or dislocation planes 2 placed one above the other are sort of cut loose from each other as parallel dislocations, and this cutting proceeds through the whole object 1. Repeated shearing together with a pressure pressing the walls of the object 1 produces compacting. In this connection, bringing the high-viscosity concrete mix mechanically under pressure means that a compression is caused in the concrete mix, e.g., by pressing the deck plane of the mould downwards. The presentation in FIG. 2 is, of course, only a presentation illustrating the process of compacting of the high-viscosity concrete mix. Of course, in practical performance, the side walls remain plane, i.e. it is assumed that the thickness of the lamellae is close to zero. Nevertheless, an efficient "shearing" of the concrete mix takes place in the concrete object 1 to be compacted, in the way described above, throughout the entire object.

FIGS. 3 and 4 show a mould for casting on site of large concrete objects or corresponding elements and for compacting of high-viscosity concrete mix. The mould 3 comprises a bottom 8, stationary side walls 6 and 7, as well as a horizontal mould deck 9 movable in the vertical direction by means of a cylinder-piston device 12. At the plane of the mould 3 bottom 8, pivotable walls 4 and 5 of the mould 3 have been mounted by means of horizontal shafts 10 and 11. The side walls 4 and 5 of the mould 3, pivoting at their upper parts, are, by means of articulated joints 14 and 15, connected to a connecting rod 13, and to the other end of the connecting rod a horizontal cylinder-piston device 16 has been connected, by means of which, via the connecting rod 13, synchronized back-and-forth pivoting movement of the pivotable side walls 4 and 5 of the mould 3 is produced. Thus, the side walls 4 and 5 pivot by means of the cylinder-piston device 16 and of the connecting rod 13 around the shafts 10 and 11 in the way shown by broken lines in FIG. 4.

Thus, when the concrete object is being cast, the mould 3 is filled with the high-viscosity concrete mix and the concrete mix is compressed from above by means of the mould deck 9 by pressing the deck downwards by means of the cylinder-piston device 12. Thereby the high-viscosity concrete mix in the mould 3 is brought mechanically under pressure. Hereupon, repeated parallel dislocations back and forth are produced in the parallel dislocation planes of the high-viscosity concrete mix by pivoting two opposite mould 3 walls 4 and 5 by means of a cylinder-piston device 16 and of a connecting rod 13 around the shafts 10 and 11 synchronously always in the same direction in relation to one another. The cylinder-piston device 12 presses the mould 3 deck 9 by a uniform force, whereat a pressure is produced in the concrete to be compacted, e.g. about 0.5 to 1 bar.

Above, the process of working of concrete mix has been described as casting taking place in a stationary mould. In slide-casting, the process is in principle the same, but, of course, the dislocation planes of the casting mix become normal planes of the longitudinal direction of the casting base, and in slide-casting there are also several successive casting-mix compacting zones.

When long pieces are slide-cast, the casting base or bottom plane 34 may have a length of up to hundreds of meters. The casting machine moves along the base from end to end, shaping and compacting the concrete. Thereat the slide-casting mould is formed by the casting base along with the side walls of the casting machine that contact the casting mix. The longitudinal reinforcement 36 of the piece or pieces extends as continuous through the entire length of the casting base. The casting machine moves on the bottom plane 34 along rails 67 as supported by the wheels 66. The casting machine comprises a body frame 65, side walls 38 and 39 of the slide-casting mould 33, mould deck 37, operating means controlling the movement of the portions 40 to 43 and 50 to 53 of the side walls 38 and 39 of the mould, which operating means may consist of cylinder-piston devices 60 to 63, as well as the feeder device 64 of the slide-casting mould 33. Before the parallel side walls 44 and 54 at the outlet end of the slide-casting mould 33, within the casting line concerned, walls or wall portions 40 to 43 and 50 to 53 are provided as fitted to each other or to their corresponding portions, provided as pairs, as pivotable always in the same direction around substantially vertical shafts 45 to 49 and 55 to 59 included in their planes. By pivoting the wall portions 40 to 43, 50 to 53 of the slide-casting mould 33 by means of the cylinder-piston devices 61 to 63, repeated parallel dislocations back and forth can be produced in the concrete mix 35 passing forwards in relation to the side walls of the mould 33 in parallel displacement planes placed transversally to the longitudinal direction of the casting base in the concrete mix 35. For example, as comes out from FIGS. 8 and 9, by means of the cylinder-piston device 63, by the intermediate of the bracket iron 68, the transverse movement can be transferred to the articulated shafts 48 and 58 and further to the wall portion 42, 43, 52, 53. Also, at the cylinder-piston devices 60, 61 and 62, the connections of the cylinder-piston devices by the intermediate of the bracket irons 33 to the articulated joints in the walls of the mould 33 are similar to that described in connection with the cylinder-piston device 63.

When slide-casting is performed, high-viscosity concrete mix is fed by means of a feeder device 64 onto the bottom plane 34 between the side walls 38 and 39 of the slide-casting mould 33. The deck 37 of the slide-casting mould 33 is gently sloping down and backwards in the direction of progress of the mould 33, whereby, by means of the deck 37 and/or the feeder device 64, the high-viscosity concrete mix in the mould 33 can be brought under pressure mechanically. When the wall portions 40 to 43 and 50 to 53 of the slide-casting mould 33 are displaced from their centre positions, the concrete placed between the wall portions is worked so that the aggregate particles glide in relation to each other. From the gliding of the aggregate particles it follows that the particles assume positions tightly in contact with each other and that any air is removed from the spaces between them. It is an essential feature of the present slide-casting method that the compacting of the high-viscosity concrete mix 35 takes place in more than two zones, which are shifted in the longitudinal direction of the piece as the casting proceeds. The compacting movement is at its maximum at the initial stage of the casting, i.e. within the first zone, and is reduced towards the end of the casting so that, at the last stage, i.e. between the last compacting pair of walls 43 and 53, the compacting movement is approximately equal to the "elastic" yield capacity of the compacted fresh concrete. The compacting movement is, however, repeated tens or hundreds of times in respect of each piece. Within the first compacting zone of the slide-casting mould 33, i.e. at the first mobile pair of walls, the displacement of the walls in the lateral direction is largest, and preferably such that the pair of walls is displaced from its centre position by about 10 to 15°, within limits permitted by the reinforcement strands. The frequency of oscillation of the moving parts 40 to 43 and 50 to 53 of the walls 38 and 39 of the slide-casting mould 33 is at the maximum 10 to 20 oscillating per second, preferably 2 to 10 oscillations per second.

Thus, by means of the prior-art technique, it has only been possible to cast pieces whose cross-sectional wall thickness is usually considerably below one hundred millimeters. Compacting of a higher thickness causes difficulties, or it is necessary to use a rather low-viscosity concrete mix, which requires some support after the casting in order to maintain its shape. On the contrary, according to the present invention, the slide-casting takes place by means of the principle of shearing and compacting, whereat repeated parallel dislocations back and forth are produced in the various regional zones of the mechanically pressurized high-viscosity concrete mix, especially in the parallel dislocation planes perpendicular to the longitudinal direction of the casting base in the concrete mix making progress in relation to the side walls of the mould. Thus, during compacting, the high-viscosity concrete mix is worked at the casting point by means of wall portions movable transversally in relation to the direction of movement of the mould 33, provided in the side walls 38 and 39 of the slide-casting mould 33. The casting space is given such a shape and/or the feeding of the concrete takes place so that the positive pressure within the entire compacting area is at least 0.3 bar. Thus, for example, the casting space becomes narrower as the compacting goes further. Of course, in the slide-casting method in accordance with the invention, the piece to be compacted does not have to have a square or rectangular cross-sectional shape, but a great number of different alternative cross-sectional shapes may be concerned. The faces of the piece to be compacted may also be, e.g., curved faces, or they may be provided with furrows in the longitudinal direction of the piece. In stead of concrete mix, the casting mix may also consist of some other high-viscosity mix suitable for the compacting method now concerned.

What is claimed is:

1. A method for continuous slide-casting of concrete objects or corresponding elements for compacting a high-viscosity mix in a slide-casting mold having a casting base and opposite wall portions comprising:

producing only parallel dislocations back and forth in various regional zones of the mechanically pressurized high-viscosity casting mix present in the mold, and in particular in parallel dislocation planes of the casting mix placed perpendicularly to the longitudinal direction of the casting base, pivoting at least two opposite wall portions of the slide-casting mold so as to be synchronized and always in the same direction in relation to each other, said pivoting provided around substantially parallel vertical shafts placed at a distance from each other, included in the planes of the mold walls, and being placed side by side in relation to the longitudinal direction of the casting base.

2. A method as claimed in claim 1, wherein the frequency of oscillation of the portions of the walls of the slide-casting mold is, at the maximum, 10 to 20 oscillations per second.

3. A method as claimed in claim 1, wherein the wall portions of the slide-casting mold, at a first compacting zone, are displaced by the pivoting from a center position by about 10° to 15°.

4. A method as claimed in claim 1, wherein the frequency of oscillation of the portions of the walls of the slide-casting mold is, at the maximum, 2 to 10 oscillations per second.

* * * * *